US008047700B2

(12) United States Patent
Massabki et al.

(10) Patent No.: US 8,047,700 B2
(45) Date of Patent: Nov. 1, 2011

(54) LIGHT STRING SYSTEM

(75) Inventors: Joseph M. Massabki, Virginia Beach, VA (US); Gary L. Lawson, Suffolk, VA (US); Chung-wai (Paul) Cheng, Hong Kong (HK)

(73) Assignee: Polygroup Macau Limited (BVI) (VG)

( * ) Notice: Subject to any disclaimer, the term of this patent is extended or adjusted under 35 U.S.C. 154(b) by 24 days.

(21) Appl. No.: 12/505,067

(22) Filed: Jul. 17, 2009

(65) Prior Publication Data

US 2009/0279325 A1 Nov. 12, 2009

Related U.S. Application Data

(63) Continuation of application No. 11/849,423, filed on Sep. 4, 2007, now Pat. No. 7,581,870, which is a continuation of application No. 11/473,504, filed on Jun. 23, 2006, now Pat. No. 7,264,392, which is a continuation-in-part of application No. 11/214,460, filed on Aug. 29, 2005, now abandoned, and a continuation of application No. PCT/US2006/021242, filed on Jun. 2, 2006, said application No. 11/473,504.

(60) Provisional application No. 60/734,507, filed on Nov. 8, 2005, provisional application No. 60/686,550, filed on Jun. 2, 2005.

(51) Int. Cl.
*H01R 33/06* (2006.01)

(52) U.S. Cl. ..... 362/654; 362/652

(58) Field of Classification Search ..... 362/652, 362/653, 654, 655, 656, 657, 800
See application file for complete search history.

(56) References Cited

U.S. PATENT DOCUMENTS

| | | | | |
|---|---|---|---|---|
| 0,932,129 | A | | 8/1909 | Hughes |
| 1,536,332 | A | * | 5/1925 | Dam Rosendal ..... 200/51.1 |
| 2,025,564 | A | | 12/1935 | Blake |
| 2,576,363 | A | | 11/1951 | Rively et al. |
| 3,359,523 | A | | 12/1967 | Shih-woo |
| 4,727,449 | A | | 2/1988 | Fleck |
| 4,894,019 | A | * | 1/1990 | Howard ..... 439/188 |
| 4,991,071 | A | | 2/1991 | Braasch |
| 5,071,362 | A | | 12/1991 | Martens et al. |

(Continued)

FOREIGN PATENT DOCUMENTS

CN 2458789 11/2001

(Continued)

OTHER PUBLICATIONS

International Search Report & Written Opinion for related PCT Application No. PCT/US2006/021242 dated Oct. 4, 2006.

(Continued)

*Primary Examiner* — David V Bruce
(74) *Attorney, Agent, or Firm* — Ryan A. Schneider, Esq.; Robert A. Madayag, Esq.; Troutman Sanders LLP

(57) ABSTRACT

The present invention is a lamp system for use in a light string system comprising a light assembly and a socket assembly. The light assembly comprises a light source, a base in communication with the light source, and a bypass activating system. The socket assembly comprises a socket adapted to receive the light assembly and a bypass mechanism having a first position and a second position. The bypass activating system is adapted to move the bypass mechanism between the first and second positions.

19 Claims, 12 Drawing Sheets

U.S. PATENT DOCUMENTS

| | | | | |
|---|---|---|---|---|
| 5,139,343 | A | 8/1992 | Lin | |
| 5,281,158 | A | 1/1994 | Lin | |
| 5,453,664 | A | 9/1995 | Harris | |
| 5,455,484 | A | 10/1995 | Maya et al. | |
| 5,702,262 | A | 12/1997 | Brown et al. | |
| 5,994,845 | A | 11/1999 | Gibboney, Jr. | |
| 6,053,774 | A | 4/2000 | Lin | |
| 6,157,139 | A | 12/2000 | Gibboney, Jr. | |
| 6,203,169 | B1 | 3/2001 | Coushaine et al. | |
| 6,224,415 | B1 | 5/2001 | Gibboney, Jr. | |
| 6,257,740 | B1 | 7/2001 | Gibboney, Jr. | |
| 6,283,797 | B1 | 9/2001 | Wu | |
| 6,533,437 | B1 | 3/2003 | Ahroni | |
| 6,609,814 | B2 | 8/2003 | Ahroni | |
| 6,650,065 | B1 | 11/2003 | Shieh | |
| 6,713,971 | B1 | 3/2004 | Wong | |
| 6,755,552 | B2 | 6/2004 | Lee | |
| 6,765,313 | B2 | 7/2004 | Janning | |
| 6,774,549 | B2 | 8/2004 | Tsai et al. | |
| 6,805,463 | B2 | 10/2004 | Shieh | |
| 6,806,656 | B2 | 10/2004 | Rahman | |
| 7,086,758 | B2 | 8/2006 | Janning | |
| 7,178,961 | B2 | 2/2007 | Janning | |
| 7,186,017 | B2 | 3/2007 | Kuo | |
| 7,253,556 | B1 | 8/2007 | Gibboney | |
| 7,264,392 | B2 | 9/2007 | Massabki et al. | |
| 7,279,809 | B2 | 10/2007 | Janning | |
| 7,342,327 | B2 | 3/2008 | Janning | |
| 7,453,194 | B1 | 11/2008 | Gibboney | |
| 7,473,024 | B2 | 1/2009 | Gibboney | |
| 7,484,995 | B2 | 2/2009 | Ding | |
| 7,554,266 | B1 | 6/2009 | Chen | |
| 7,557,497 | B1 | 7/2009 | Gibboney | |
| 7,581,870 | B2 | 9/2009 | Massabki et al. | |
| 2003/0142494 | A1* | 7/2003 | Ahroni | 362/251 |
| 2003/0198044 | A1 | 10/2003 | Lee | |
| 2004/0105270 | A1 | 6/2004 | Shieh | |
| 2005/0041422 | A1 | 2/2005 | Janning | |
| 2005/0122723 | A1 | 6/2005 | Frederick | |
| 2005/0286267 | A1* | 12/2005 | Wang | 362/653 |
| 2006/0146578 | A1 | 7/2006 | Kuo | |
| 2006/0274556 | A1 | 12/2006 | Massabki et al. | |
| 2007/0159109 | A1 | 7/2007 | Gibboney | |
| 2007/0297196 | A1 | 12/2007 | Massabki et al. | |
| 2008/0024071 | A1 | 1/2008 | Yu | |
| 2008/0130284 | A1 | 6/2008 | Altamura et al. | |
| 2008/0186740 | A1 | 8/2008 | Huang et al. | |
| 2008/0239758 | A1 | 10/2008 | Ng | |
| 2008/0258630 | A1 | 10/2008 | Collins et al. | |
| 2008/0303446 | A1 | 12/2008 | Ding | |
| 2009/0190359 | A1 | 7/2009 | Li | |
| 2010/0099285 | A1 | 4/2010 | Li et al. | |

FOREIGN PATENT DOCUMENTS

| | | |
|---|---|---|
| CN | 2583839 | 10/2003 |
| CN | 2595018 | 12/2003 |
| CN | 1145242 | 4/2004 |
| CN | 2702165 | 5/2005 |
| DE | 9207136 | 8/1992 |
| EP | 0109911 | 5/1984 |
| EP | 0346969 | 12/1989 |
| EP | 0740105 | 10/1996 |
| EP | 1092915 | 4/2001 |
| EP | 1111292 | 6/2001 |
| JP | 5043092 | 12/1975 |
| JP | 6088499 | 6/1985 |
| JP | 63164198 | 10/1988 |
| JP | 2103898 | 4/1990 |
| JP | 641119 | 5/1994 |
| JP | 6140163 | 5/1994 |
| JP | 787691 | 3/1995 |
| JP | 8171972 | 7/1996 |
| JP | 11185978 | 7/1999 |
| JP | 11288252 | 10/1999 |
| JP | 200176507 | 3/2001 |
| JP | 2003208993 | 7/2003 |
| WO | 9110093 | 7/1991 |
| WO | WO 2006/130751 | 12/2006 |

OTHER PUBLICATIONS

Supplementary European Search Report for European Application No. EP06760620 dated Jul. 11, 2008.

International Search Report & Written Opinion for related PCT Application No. PCT/US2006/021242 dated Oct. 4, 2006.

Supplementary European Search Report for European Application No. EP06760620 dated Jul. 11, 2008.

* cited by examiner

LIGHT STRING SYSTEM

CROSS REFERENCE TO RELATED APPLICATIONS

This patent application is continuation of U.S. patent application Ser. No. 11/849,423, filed 4 Sep. 2007, which is a continuation of U.S. patent application Ser. No. 11/473,504, filed 23 Jun. 2006, now U.S. Pat. No. 7,264,392, which is a continuation-in-part of U.S. patent application Ser. No. 11/214,460, filed 29 Aug. 2005, which claims benefit of priority under 35 U.S.C. 119(e) to U.S. Provisional Patent Application No. 60/686,550, filed on 2 Jun. 2005. U.S. patent application Ser. No. 11/473,504 also claims benefit of priority under 35 U.S.C. 119(e) to U.S. Provisional Application No. 60/734,507, filed 8 Nov. 2005, and is a continuation of PCT patent application PCT/US2006/21242, filed on 2 Jun. 2006.

The entire contents and substance of U.S. patent application Ser. No. 11/849,423, filed 4 Sep. 2007; U.S. patent application Ser. No. 11/473,504, filed 23 Jun. 2006, now U.S. Pat. No. 7,264,392; U.S. patent application Ser. No. 11/214,460, filed 29 Aug. 2005; U.S. Provisional Patent Application No. 60/686,550, filed on 2 Jun. 2005; U.S. Provisional Application No. 60/734,507, filed 8 Nov. 2005; and PCT patent application PCT/US2006/21242, filed on 2 Jun. 2006 are hereby incorporated by reference.

FIELD OF THE INVENTION

The present invention relates to a lamp system used in a light string system and, more particularly, to a socket assembly adapted to receive a light assembly, wherein the lamp system is designed such that a remainder of the lights in the light string system remain lit even when one or more individual light assemblies are missing from associated socket assemblies.

BACKGROUND OF THE INVENTION

Light strings are known in the art. Light strings are predominantly used during the holiday season for decorative purposes (e.g., Christmas tree lights, outdoor holiday lights, and icicles light sets).

Conventional light strings are arranged with lights on the strings being electrically connected in series, rather than in a parallel arrangement. Unfortunately, there are disadvantages to designing a light string in series. When even a single light bulb is removed from a socket, the entire series of lights is rendered inoperable. Because each light bulb within its respective socket completes the electrical circuit, when a light bulb is removed or the filament of the bulb burns out, a gap is created in the circuit, i.e., an open circuit is formed. Therefore, electricity is unable to continue to flow through the circuit. When a "good" or operable light bulb is inserted into the socket, it completes the circuit, and allows electricity to flow uninterrupted.

There have been many attempts at improving series-designed light strings to overcome the "open circuit" problem of prior art devices. For instance, U.S. Pat. No. 5,453,664, to Harris, is directed to a light bulb shunt system that is configured to shunt the electronic current passing through the light bulbs if a filament breaks or is removed from the socket. Additionally, U.S. Pat. No. 6,257,740, to Gibboney, Jr., discloses a socket having a very particular spring mechanism arrangement to act as a shunt allowing electricity to continue to flow through the remainder of lights on the string when a light bulb is missing. The Gibboney, Jr. patent requires the implementation of two cantilevered springs, wherein the springs separate when the light source is inserted into the socket, and the springs come together when the light source is removed from the socket. Therefore, the Gibboney, Jr. patent results in a complicated, expensive manufactured design.

Another attempt to improve series-designed light strings is described in U.S. Pat. No. 6,533,437 to Ahroni. Ahroni discloses a socket of a light unit having two specific mechanical springs to shunt electricity, whereby enabling electricity to flow through the light string when a light bulb is loose or removed from the light string. The mechanical shunts disclosed in Ahroni include (i) a socket having a horizontally positioned spring device and (ii) a pair of impinged metal strips. In one embodiment, the horizontal coil spring is adapted to shunt the socket. The shunt disables when the light source is seated in the socket, wherein an actuating member disables a connection between one end of horizontal spring and a contacting element. Another embodiment of Ahroni includes displacing two metal strips from one another. The actuating stub of the light source is adapted to impinge against a long metal strip to displace contact away from a short metal strip, whereby opening the switch to enable electricity to flow through the light source. The long metal strip is positioned beneath the shorter metal strip and serves as a moveable element of the switch. A contact end portion of long metal strip is displaceable downward away from the small metal strip to disconnect the metal strips from one another, or break the circuit path.

U.S. Pat. No. 5,702,262 to Brown discloses an electrical connector for a pair of connectors disposed in a housing. The electrical connector includes an actuator assembly having a pair of spring arms, specifically made of insulating material. It has been suggested that a combination of Ahroni and Brown would provide a beneficial light assembly. Yet, Ahroni discloses "a highly cost effective and uncomplicated way to maintain power throughout a light string to inspect for loose bulbs." Brown is an expensive and complicated connector assembly. Brown discloses an electrical connector for a pair of connectors disposed in a housing. Not only would be impractical and expensive to include the Brown connector within a light string system, such as Ahroni, but such a combination would not provide a suitable light assembly, as the Brown spring arms are insulators, and only conducting arms would work in a light string assembly.

In view of the disadvantages with conventional designs of light in series, it would be beneficial if a light string system could be designed to allow the electricity to continue to flow with a missing bulb and/or burned out bulb in a simple, easy and economical construction. It is to such a system and device that the present invention is primarily directed.

SUMMARY OF THE INVENTION

The present invention is a lamp system for use in a light string system, the lamp system comprising a light assembly and a socket assembly. The light assembly comprises a light source, a base in communication with the light source, and a bypass activating system. The socket assembly comprises a socket adapted to receive the light assembly and a bypass mechanism having a first position and a second position. The bypass activating system is adapted to move the bypass mechanism between the first and second positions.

The light source of the light assembly provides light when energized. The light source can have a filament, which when charged with energy illuminates the light source. A plurality of conductors can be in electrical communication with the filament. The conductors allow energy to pass through the light source to illuminate the filament, and the light source.

Although the present invention is primarily directed to a system that enables series-connected lights to remain lit when a light source is missing from a particular socket, the light assembly itself can incorporate a shunting device to enable remaining lights to be lit when a bulb is not removed, but burned out. In one embodiment, the light source of the light assembly in the series-connected light string can have an internal shunting device to provide a current path when the filament of a light source opens, so that the remaining light sources in the series-connected string remain illuminated.

The base of the light assembly can be of unitary construction with the light source, or a separate element. Preferably, the base communicates between the light source and an associated socket, complimenting and facilitating the seating of the light assembly into the socket assembly. The base can incorporate ridges to enable snug fitting of the light assembly into the socket assembly, or the base can have an appropriately-designed extension that cooperates with an extension of the socket assembly to provide a fastening means between the light assembly and the socket assembly ensuring a clasped connection that limits accidental removal of the light assembly from the socket assembly.

The bypass activating system of the light assembly extends from the exterior of the base. The bypass activating system enables or disables the bypass mechanism.

The socket of the socket assembly defines a cooperatively-shaped aperture to receive the base of the light assembly and is further adapted to receive, preferably, the whole of the bypass activating system, which in a preferred form extends from the base. Additionally, the socket can have terminal wires entering from the exterior to allow energy to pass through the socket.

The bypass activating system of the socket assembly comes into contact with the bypass mechanism. The bypass mechanism has a first position and a second position. The first position bypasses energy flow from the light assembly through the socket when a light assembly is not properly seated (or not seated at all) in the socket. The second position enables energy to flow through the light source to illuminate it. The bypass mechanism can include a spring mechanism, which, in a preferred embodiment, incorporates a single spring.

In the first position, the spring mechanism extends to make contact with conductive elements of the socket, preferably being opposing sides of the socket. Alternatively, in another embodiment, in the first position, the spring mechanism can extend to make contact with contacting members. As a result, an electrical circuit is created, i.e., a short circuit is formed across the spring mechanism. This situation arises when the light source is absent the socket.

In the second position, the electrical circuit through the spring mechanism is disconnected, i.e., an open circuit is formed across the spring mechanism. The disconnection is caused by the bypass activating system, wherein the light assembly is properly inserted into the socket.

When the light assembly is inserted into the socket, the bypass activating system is designed to move the spring mechanism from the first position to the second position. In the second position, an open circuit is created across the spring mechanism. Since the exterior of the base of the light assembly has lead wires, once the light assembly is inserted into the socket a predetermined distance, the lead wires come into contact with conductive elements, which connect to terminal wires for power. When the energy flows, the circuit then goes through the filament of the light source and illuminates the light source.

These and other objects, features, and advantages of the present invention will become more apparent upon reading the following specification in conjunction with the accompanying drawings.

DETAILED DESCRIPTION

To facilitate an understanding of the principles and features of the invention, it is explained hereinafter with reference to its implementation in an illustrative embodiment. In particular, the invention is described in the context of being a lamp system of a light string system.

The invention, however, is not so limited to its use as a lamp system having a bypass. Rather, the invention can be used wherever a circuit or other system with a mechanical shunt device is needed or desired. For example, although the present invention is described as controlling flow through a light assembly when seated/unseated from a socket assembly, it will be understood that the disclosed socket assembly can be used with other insertable assemblies to contact/shunt electrical flow through the insertable assembly.

Figure 1:
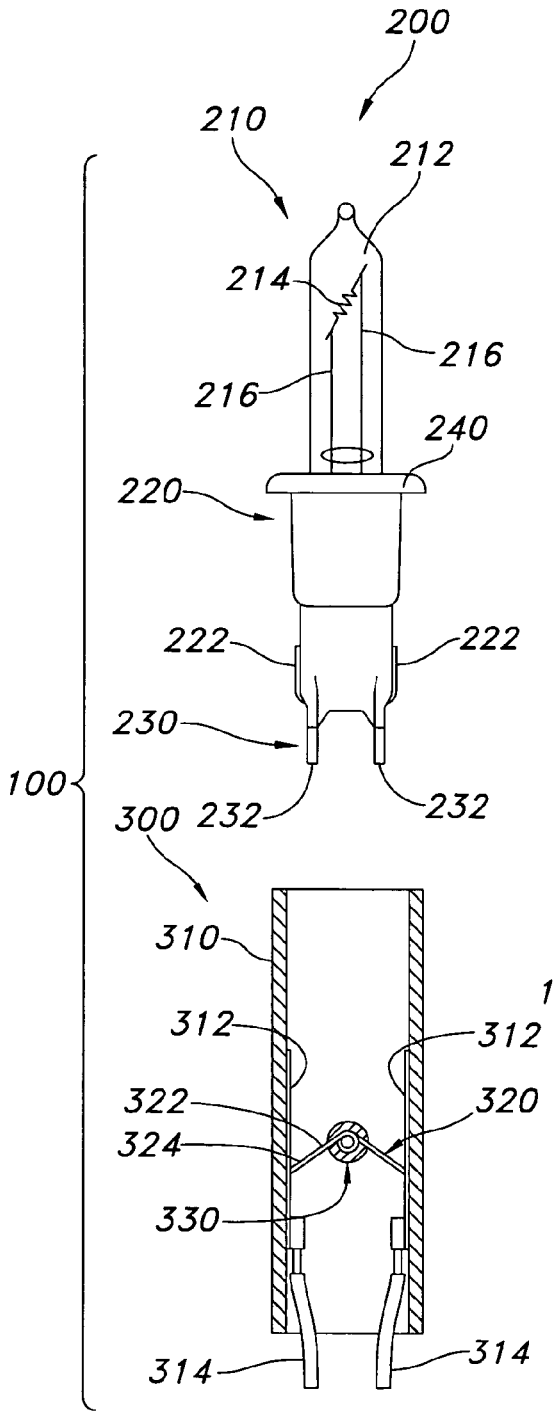
FIG. 1 is a cross sectional view of a lamp system for use in a light string system according to a preferred embodiment of the present invention.

Referring now in detail to the figures, FIG. 1 is a partial cross-sectional view of a first preferred embodiment of a lamp system for use in a light string system. A typical light string system comprises a plurality of lamp systems 100 connected in series, wherein each lamp system 100 has a light assembly 200 and a socket assembly 300. The light assembly 200 comprises a light source 210, a base 220 in communication with the light source 210, and a bypass activating system 230.

The socket assembly 300 comprises a socket 310 adapted to receive the light assembly 200 and a bypass mechanism 320 having a first position and a second position.

The light assembly 200 includes the light source 210. The light source 210 provides light when energized. One skilled in the art can appreciate that the light source 210 can be many types of light sources, including a light bulb, light emitting diode (LED), incandescent lamp, halogen lamp, fluorescent lamp, and the like. Preferably, the light source 210 is a light bulb. The light assembly 200, and more typically, the light bulb 210 of the light assembly 200 has a shunt device (not shown) to keep the light string system illuminated, even if the bulb 210 burns out.

The light source 210 can include a globe 212 and a filament 214. The globe 212 is in communication with, and terminates at, the base 220. The globe 212 can be made of conventional translucent or transparent material such as plastic, glass, and the like. Typically, the globe 212 includes a hollow interior enabling protection of the filament 214.

The filament 214, when charged with energy, illuminates the light source 210. Conductors 216 can be in electrical communication with the filament 214. The conductors 216 enable energy into the light source 210 to illuminate the filament 214, and as a result the light source 210. The conductors 216 extend down through the base 220, wherein preferably the conductors 216 can be in communication with a pair of lead wires 222 external the base 220. The lead wires 222 extend through a bottom of the base 220, and are a pair of wires wrapped around the base 220 extending upwardly in the direction of globe 212, adjacent the base 220.

The light assembly 200 further includes the base 220. The base 220 can be integrally formed with the light source 210. The base 220 can be a unitary element of the light source 210, or a separate element. Preferably, the base 220 communicates between the light source 210 and an associated socket 310, complimenting and facilitating the seating of the light assembly 200 to the socket 310. The base 220 can incorporate a least one ridge 226 (see FIG. 4) to ensure a snug fit with the socket 310, preventing the accidental disengagement of the light assembly 200 from the socket assembly 300. Other mechanical means can be used with the base 220 and the socket assembly 300 to ensure a tight fit.

Figure 4:
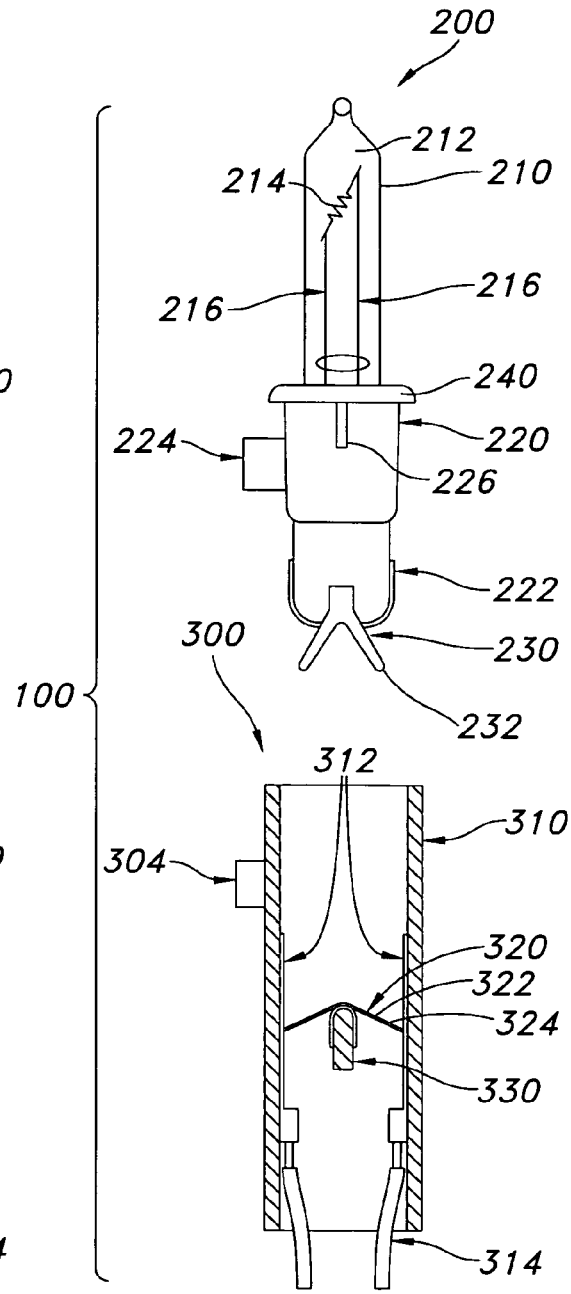
FIG. 4 is a cross sectional view according to another preferred embodiment of the present invention illustrating the lamp system for use in a light string system.

For example, the light assembly 200 can also include a locking assembly to secure the light assembly 200 to the socket assembly 300. The locking assembly may be exterior, or designed within the socket assembly 300 to fasten the connection of the light assembly 200 to the socket assembly 300 internally. In an exemplary embodiment, as shown in FIG. 4, the locking assembly is external and can include cooperating light assembly elements 224 and socket assembly element 304. These elements 224 and 304 can be formed as a clasp and a lock to insert the clasp. For example, the base 220 of the light assembly 200 can include the element 224 that extends normal to the base 220 and can define an aperture. On the other end of the locking assembly can be the element 304 from the socket 310 to be inserted into the element 224 of the base 220. As the element 304 of the socket 310 is inserted into the element 224 of the base 220, the locking assembly is complete. Stringent Underwriters Laboratories (UL) requirements, however, have required that lights and sockets fit tightly together, this may decrease the value of a locking mechanism in the lamp system 100. The improvement in injection molding machines now enables the production of sockets and lamp assemblies that have a tight, snug fit.

The bypass activating system 230 preferably extends in a downward direction from base 220 of the light assembly 200, and is used to activate the bypass mechanism 320 of the socket assembly 300 upon the proper seating of the light assembly 200 therein. In one embodiment of the present invention, the bypass activating system 230 can be in a downward "V" shape (see FIG. 4). Alternatively, the bypass activating system 230 can be one or more extending members 232 (see FIG. 1).

The socket assembly 300 comprises the socket 310 adapted to receive the light assembly 200. The socket 310 defines a cooperatively-shaped aperture to receive the base 220 of the light assembly 200. In a preferred embodiment, the socket 310 is also adapted to receive the whole of the bypass activating system 230 of the light assembly 200. The socket 310 can be arranged in many shapes and sizes, but as one skilled in the art will recognize, the socket 310 should be of a shape to conveniently receive the light assembly 200.

The socket 310 includes a pair of socket terminals 312. The socket terminals 312 are, preferably, located on opposing inner sides of the socket 310. The socket 310 further includes a pair of terminal wires 314 extending to the exterior to allow energy to enter (and exit) the socket 310. Each socket terminal 312 is, essentially, an extension of each respective terminal wire 314. The terminal wire 314 extends through the bottom of the socket 310 and is ultimately connected to an electrical source. Therefore, the electrical current is introduced into the socket 310 by one of the terminal wires 314 and conducted either through the bypass mechanism 320 if in the first position, or through lead wires 222 to the filament 214 to illuminate the light bulb 210 if in the second position. Regardless of path, the current will flow to the other of the lamp systems 100 of the light string.

The socket assembly 300 also includes the bypass mechanism 320. The bypass mechanism 320 includes a conductive element 322. The conductive element 322 sits, preferably, on a fulcrum 330 in the socket 310. The conductive element 322 has a first position and a second position. In an exemplary embodiment, the bypass mechanism 320 is positioned on a centrally-positioned fulcrum of the socket assembly 300.

As shown in FIG. 1, the bypass mechanism 320 incorporates the conductive element 322, such that an electric circuit is provided from the left terminal wire 314, through the left socket terminal 312 across conductive element 322, and ultimately to the right terminal wire 314 via the right socket terminal 312.

The conductive element 322 can be a spring mechanism 324. The socket 310 is dimensioned to receive the insertion of the bypass activating system 230, which forces the single spring 324 together, not apart, when the light assembly 200 is inserted into the socket 310. The single spring 324 springs apart, not together, when the light assembly 200 is removed from the light socket 310. The spring 324 sits about the fulcrum 330.

Figure 3:
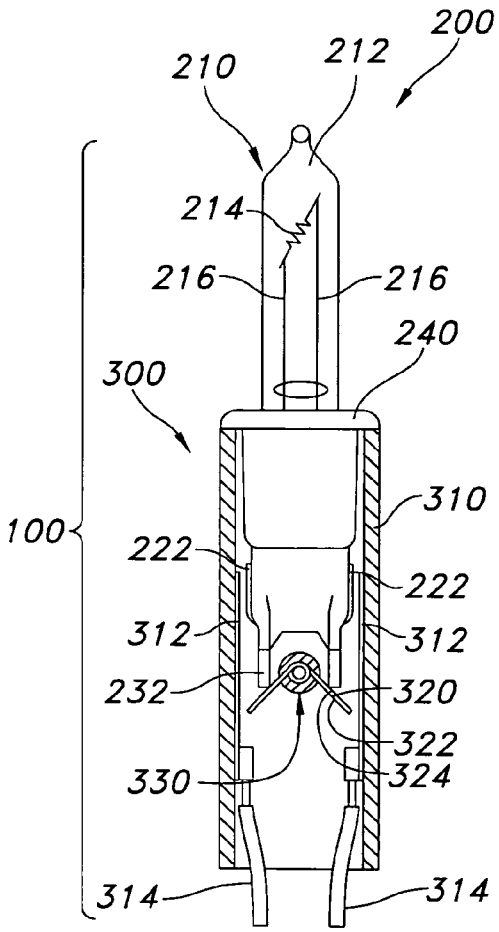
FIG. 3 is a cross sectional view of the lamp system of FIG. 1 fully inserted.

When the light assembly 200 is inserted into the socket 310, the bypass activating system 230 pushes at least one side of the conductive element 322 down, distal the socket terminal 312 to "open" the circuit across 322. This disables the electrical connection that the bypass mechanism 320 created, and the circuit is closed via the bulb 210, not the conductive element 322. As shown in FIG. 3, both sides of conductive element 322 are disengaged by the bypass activating system 230. In a preferred embodiment, the bypass mechanism 320 is a centrally fulcrumed spring mechanism about the fulcrum 330, and the two extending members 232 push both sides of the conducting element 322 away from the socket terminals 312. It will be understood that other bridging mechanisms can be used beyond fulcrum 330 to support the element 322 across the socket 310.

The bypass activating system 230 can have one or more pointed or rounded tips that facilitate disconnecting the bypass mechanism 320 from the socket terminals 312. The bypass activating system 230 disables the physical connection of the bypass mechanism 320, thereby eliminating any electrically conductive path for the electrical current to flow, other than through the inserted assembly 200.

The bypass mechanism 320 permits the removal of one or more light assemblies 200 of the lamp system 100, while maintaining the lighting of the remaining lights of a light string system. When a light assembly 200 is missing from the socket 310, the bypass mechanism 320 creates a short circuit, and therefore enables current flow to keep other lamp systems 100 with energy at each socket 310. Each socket 310 can have a single current carrying bypass mechanism 320, which pushes away from the socket terminal 312 when the bypass activating system 230 engages the bypass mechanism 320 thereby breaking electrical continuity across the bypass mechanism 320. When the base 220 of the light assembly 200 is fully engaged in the socket 310, the lead wires 222 extending from the base 220 will make electrical contact with the socket terminals 312 completing the electrical circuit. When the light assembly 200 is removed, the bypass mechanism 320 opens again and makes contact with the socket terminals 312, maintaining the electrical connection.

Figure 2:
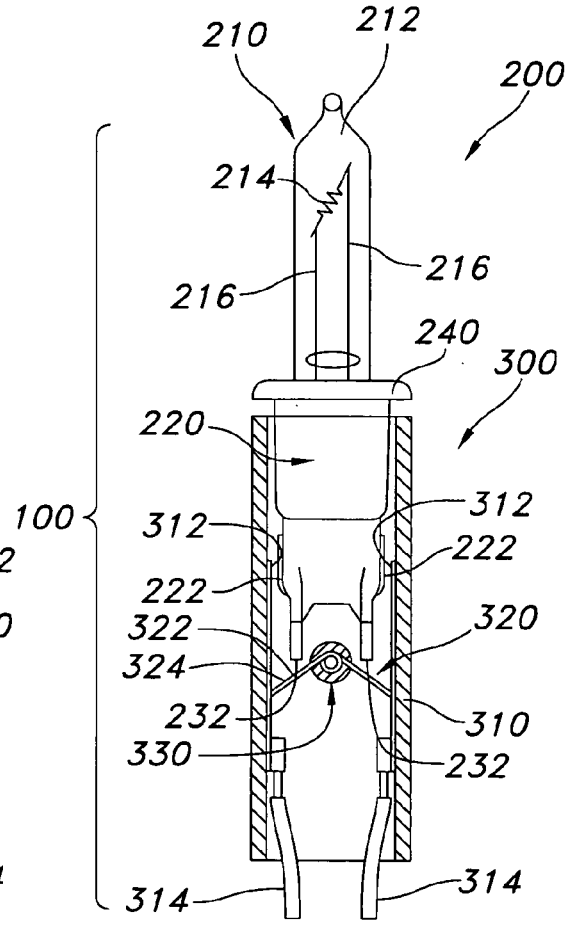
FIG. 2 is a cross sectional view of the lamp system of FIG. 1 partially inserted.

The bypass mechanism 320 has a first position and a second position. The first position bypasses energy flow when a light assembly 200 is not properly seated in the socket 310 (FIGS. 1-2). In the first position, the bypass mechanism 320 extends to make contact with the sides of the socket 310, the socket terminal 312. As a result, an electrical circuit is created, or a short circuit is formed. This situation arises when the light assembly 200 is missing from the socket 310. The second position enables energy to flow through the light source 210 to illuminate it (FIG. 3). In the second position, the bypass mechanism 320 is removed from electrical communication from at least one side of the socket 310 (at least one socket terminal 312). The electrical circuit through the bypass mechanism 320 is disconnected, or an open circuit is formed. This situation typically arises when a light assembly 200 is fully inserted into the socket 310. For instance, the bypass activating system 230 pushes the bypass mechanism 320 together when the light assembly 200 is being seated in the socket 310; and the bypass mechanism 320 pushes apart when the light source 210 is being removed from the socket 310.

FIGS. 1-3 are partial cross sectional views of a preferred embodiment of the lamp system 100 illustrating the light assembly 200 being inserted into and fully seated in the socket 310. As the light assembly 200 is inserted into the socket 310, electrical current flowing through the bypass mechanism 320 is interrupted. When physical contact between bypass mechanism 320 is broken by the bypass activating system 230, electrical current flow is then enabled to flow through the lead wires 222 and up through the conductors 216 to illuminate the light source 210. The current then resumes flowing out through the opposite side of the conductor 216 and down through the other lead wire 222, passing through the other terminal wire 314 until it exits that particular lamp system 100. A flange 240 engages socket 310 when light assembly 200 is fully seated.

FIG. 4 illustrates another preferred embodiment of the lamp system 100. The lamp system 100 includes the bypass activating system 230 shown having an upside down "V" shape. The shape of the bypass activating system 230 enables contact with the bypass mechanism 320, and further permits the switching of the bypass mechanism 320 from the first position to the second position. Additionally, in FIG. 4, the bypass mechanism 320 is positioned upon the fulcrum 330.

Figures 5A, 5B:
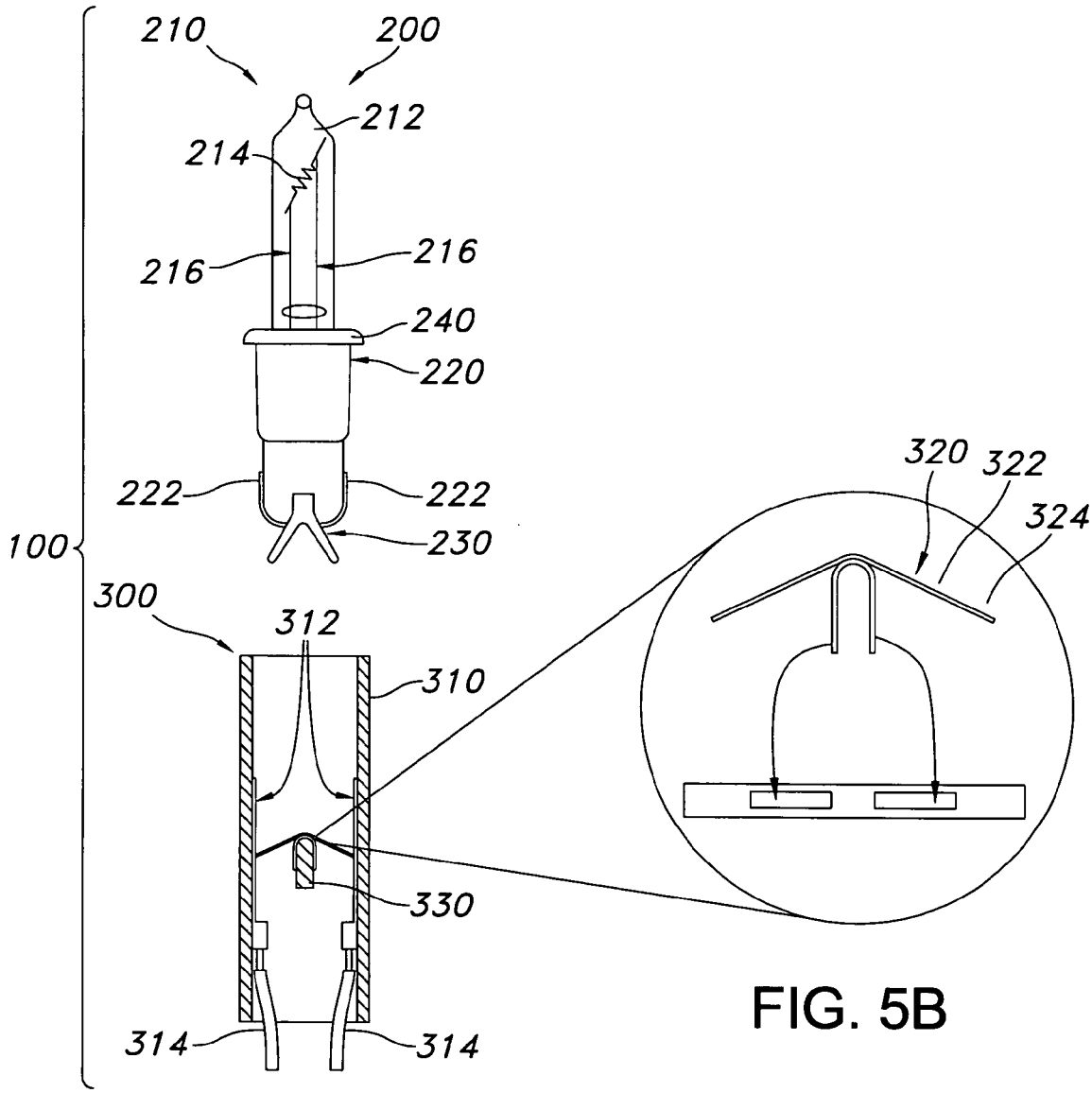
FIGS. 5A and 5B are cross sectional views of the lamp system of FIG. 4 further illustrating the detail of a bypass mechanism according to a preferred embodiment.

FIGS. 5A and 5B illustrates a cross sectional view of a lamp for use in a lamp system 100 further illustrating the detail of the bypass mechanism 320. Since the bypass mechanism 320 is preferably is a spring 324, one skilled in the art will appreciate describing the bypass mechanism 320 in terms of a spring 324. The spring 324 can be a single spring that is connected to the socket 310 with a fulcrum 330 in the socket 310. Providing a socket 310 with a centrally located, single fulcrum 330 enables easy manufacturability. One skilled in the art can appreciate that the way the spring 324 is seated in the socket 310 can be by a pivot, hinge, pin, and the like, and need not be centrally located nor must the element 322 be a single element. It can include two or more elements that can be electrically communicative through the fulcrum 330. (Essentially, this is used in the embodiment in FIGS. 9-11, wherein the contacting member 342 is shown as two distinct members, electrically communicative one end to the other when the top of the biasing member 344 completes the path.)

The spring 324 can be of the length to span the length of the diameter of the socket 310. In this arrangement, the spring 324 would create the short circuit by contacting the socket terminals 312. In alternative embodiments, the spring 324 can be in connection with a conductor (not shown) to span the length of the diameter of the socket 310.

Figure 6:
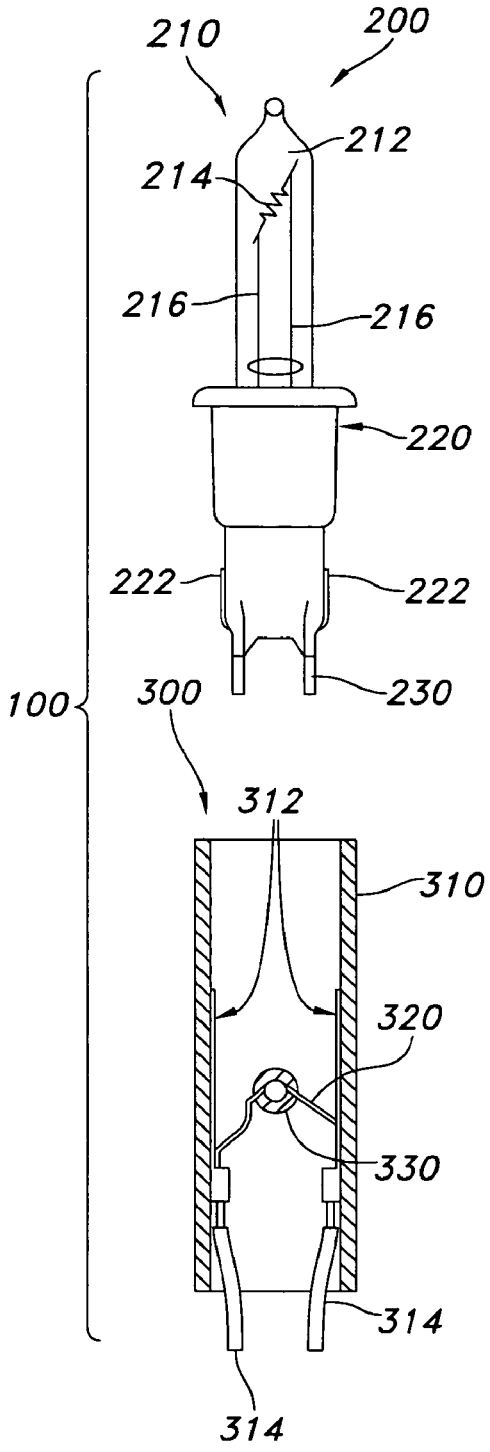
FIGS. 6-8 are cross sectional views of the lamp system for use in a light string system according to another preferred embodiment of the present invention moving from non-insertion through full insertion.
Figure 7:
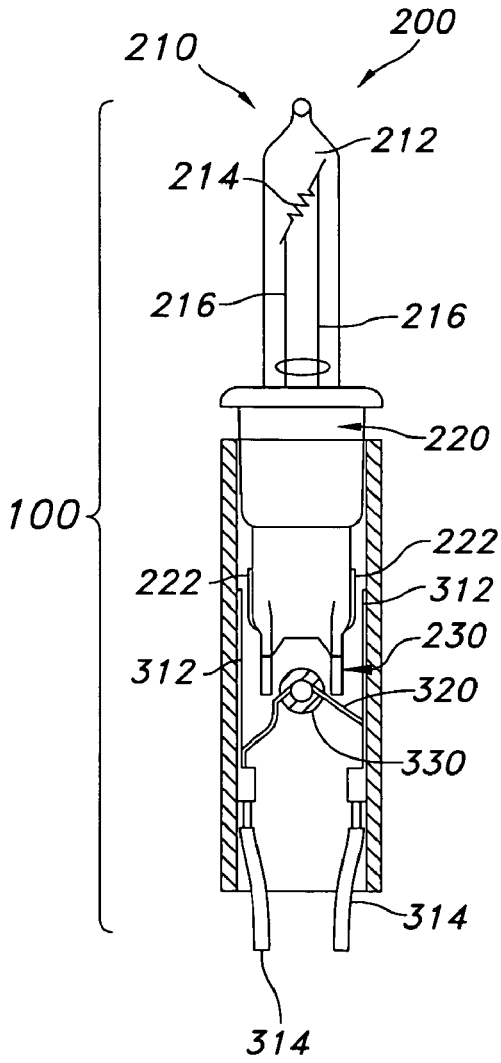
Figure 8:
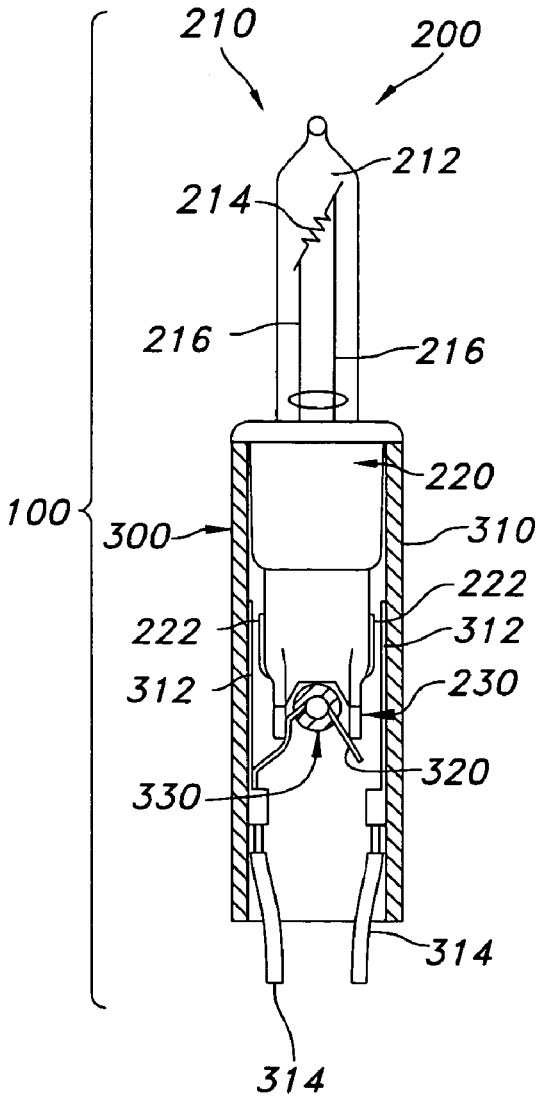

FIGS. 6-8 illustrate another preferred embodiment of the present invention. In FIGS. 6-8 the bypass activating system 230 strikes only one branch of the bypass mechanism 320. In this arrangement, the bypass mechanism 320 creates an open circuit by having the bypass activating system 230 to strike only one side of the bypass mechanism 320. The bypass activating system 230, as depicted, includes two structures extending from the base 220 of the light assembly 200. Consequently, it will be understood by one in the art that the bypass activating system 230 can include a single extending member 232 extending from the base 220. The bypass mechanism 320 still includes a first position and a second position.

In this embodiment, the left side terminal 314 is always in electrical communication with the bypass mechanism 320, only the right side of the bypass mechanism 320 is activated between the first and second positions by the bypass activating system 230.

Figure 9:
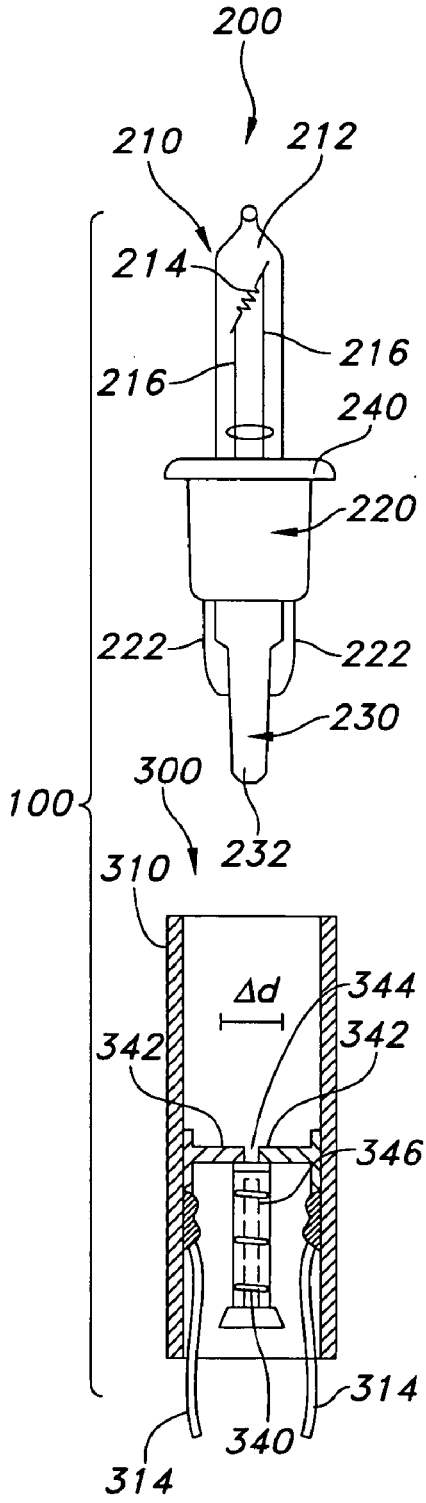
FIGS. 9-11 are cross sectional views of the lamp system for use in a light string system according to another preferred embodiment of the present invention.
Figure 10:
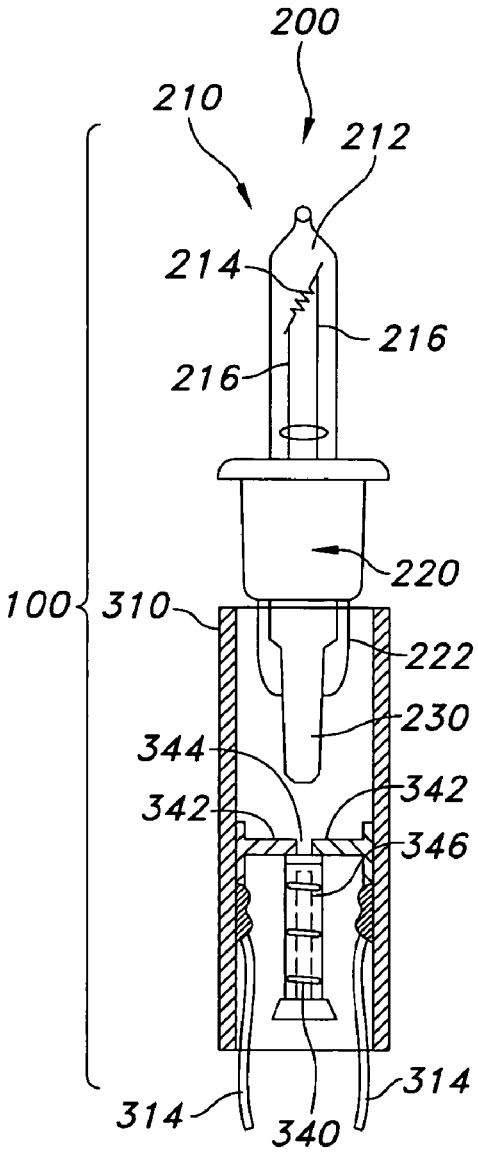
Figure 11:
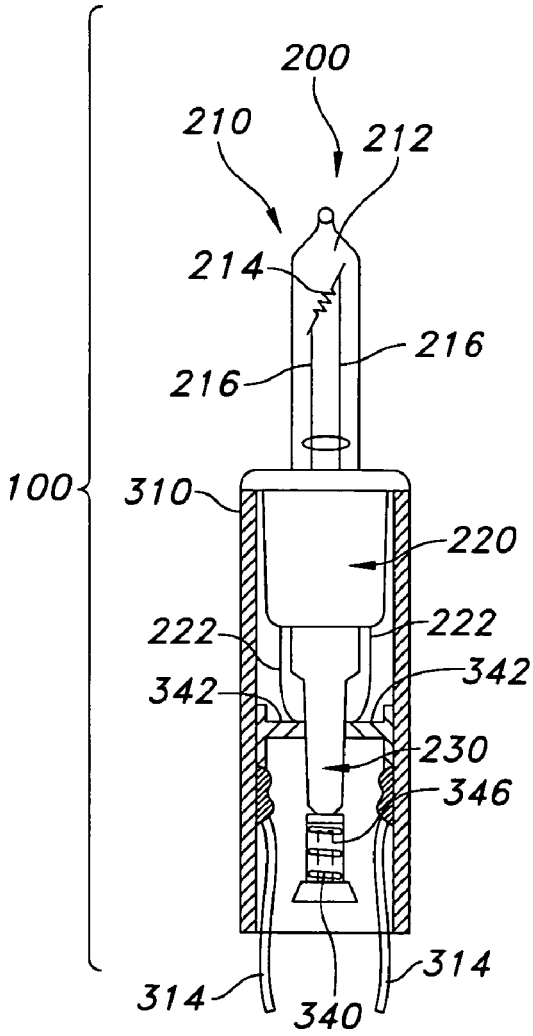

FIGS. 9-11 illustrate another preferred embodiment of the present invention. In FIGS. 9-11 the bypass activating system 230 strikes a bypass mechanism 340 as a light assembly 200 is inserted into a socket 310. Here, the bypass mechanism is a biasing member 344, of which at least the top portion is conductive. The biasing member can be, for example, a spring 346 or a topped, or a sheathed spring 346, should the spring 346 not be conductive, wherein at least the top or, the sheath of the spring 346, has a conductive layer to contact the contacting members 342 to provide an electrical path across the socket 310. The biasing member 344 can further be a zig-zag spring, a coiled spring, a hinge, and the like, wherein the top of the biasing member is electrically conductive.

The light assembly 200 is adapted to be inserted into the socket 310. The socket 310 defines an aperture sufficiently sized to receive the light assembly 200. At a predetermined depth of the socket 310, a pair of contacting members 342 are positioned. The contacting members 342 are, preferably, made of conductive material, e.g., metal, copper, and the like. The contacting members 342 extend inwardly from opposing sides of the socket 310. The contacting members 342 are separated by a predetermined distance ($\Delta d$) to permit receiving the bypass activating system 230 therethrough.

Consequently, as the light assembly 200 is inserted into the socket 310, the bypass activating system 230 can contact the bypass mechanism 340. In addition, the lead wires 222, which are connected to the base 220 of the light assembly 200, contact the contacting members 342 enabling energy to flow through the light assembly 200. The bypass mechanism 340 includes two positions—a first position and a second position. The first position bypasses energy flow when the light assembly 200 is not seated in the socket 310. The second position of the bypass mechanism 320 enables energy to flow through the light source 210, therefore illuminating it.

In this embodiment, the bypass mechanism 340 can be designed to move in an up and down motion, as the light assembly 200 is inserted into the socket 310, rather than pushed together and apart.

For instance, as illustrated in FIG. 9, which depicts the first position of the bypass mechanism 340, energy flows from the left terminal wire 314 to the left contacting member 342. The energy continues to flow through the conductive bypass mechanism 340, which acts like a shunt to connect the two contacting member 342. The energy then flows through the right contacting member 342 and out the right terminal wire 314. As the light assembly 200 is inserted into the socket, referring to FIGS. 10-11 wherein the bypass mechanism is placed in the second position, the bypass activating system 230 can push the bypass mechanism 320 away from the contacting members 342 to disable the shunt. Because at least a portion of the bypass activating system 230 is insulative, it prohibits energy to flow through the bypass mechanism 320 and, instead, allows illumination of the light source 210 of the light assembly 200.

Figure 12A:
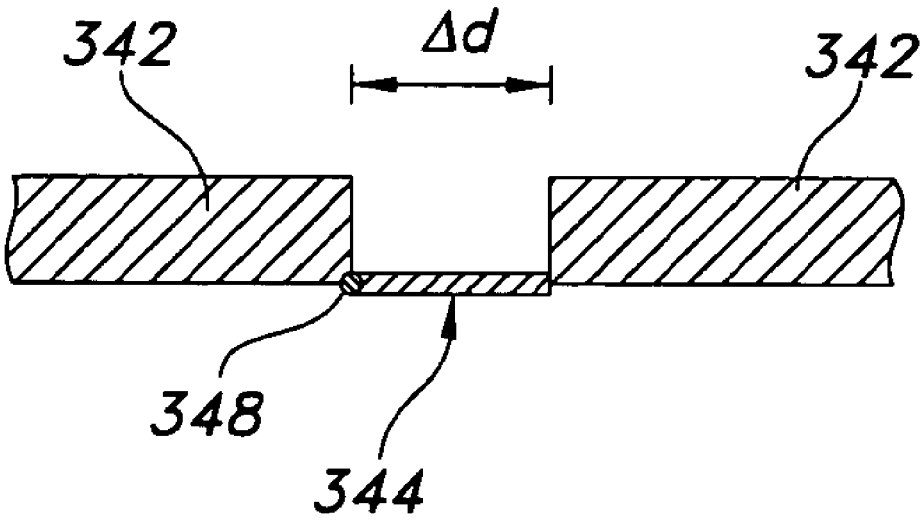
FIGS. 12*a*-12*b* is a cross sectional close-up of a biasing member according to a preferred embodiment.
Figure 12B:
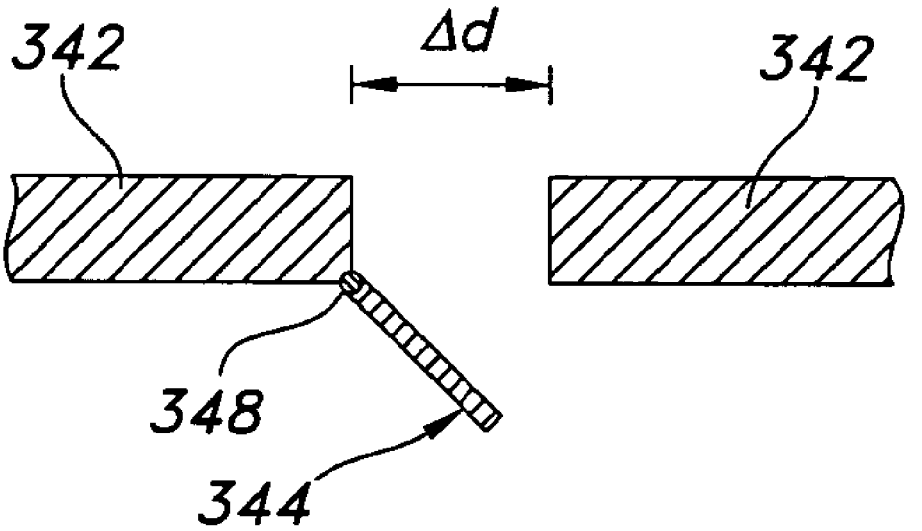

FIGS. 12*a*-12*b* depict the biasing member 344 in another preferred embodiment. As opposed to being a spring element moveable up and down out of engagement with contacting members 342, the biasing member 344 can be removed from engagement only at only end. In this embodiment, the biasing member 344 is connected to one contacting member 342 by a hinge 348 or like device. The biasing member includes two positions—a first position and a second position. The first position, shown in FIG. 12*a*, exists when a light assembly 200 is absent from the socket assembly 300, and a coil spring or the like biases the member 344 to bring the gap (Δd). As a result the biasing member 344 makes contact with both contacting member 342 enabling a short circuit or shunt across the distance between the contacting members 342 (Δd). The second position, shown in FIG. 12*b*, of the biasing member 344 exists when the light assembly is inserted into the socket assembly, wherein the biasing member 344 is disabled from the short circuit to an open circuit.

Figure 13:
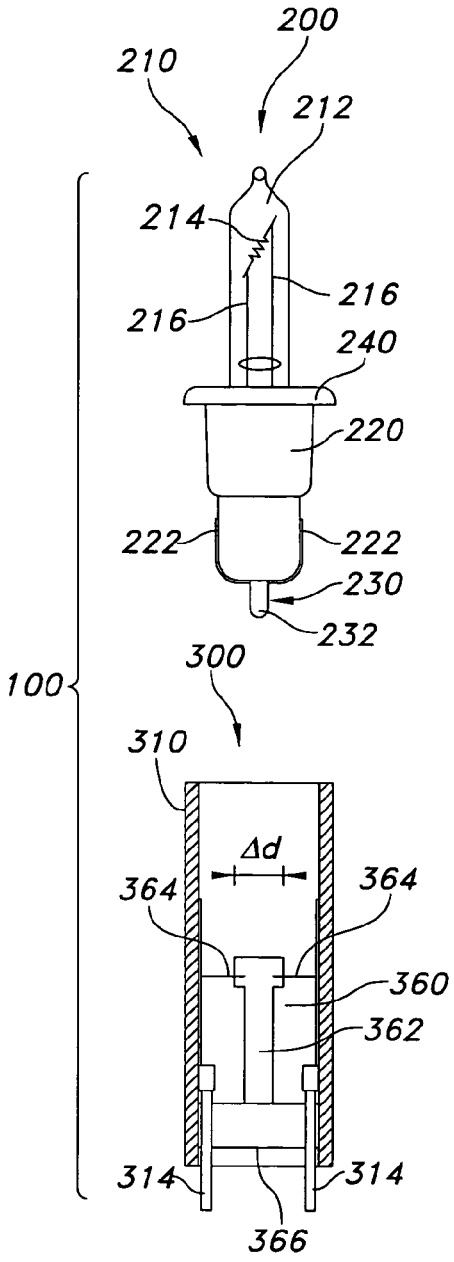
FIGS. 13-15 are cross sectional views of the lamp system for use in a light string system according to another preferred embodiment of the present invention.
Figure 14:
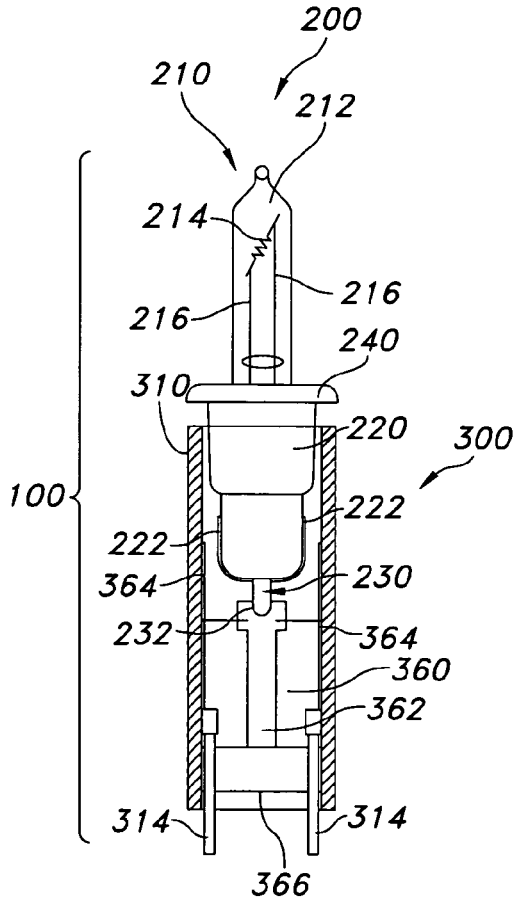
Figure 15:
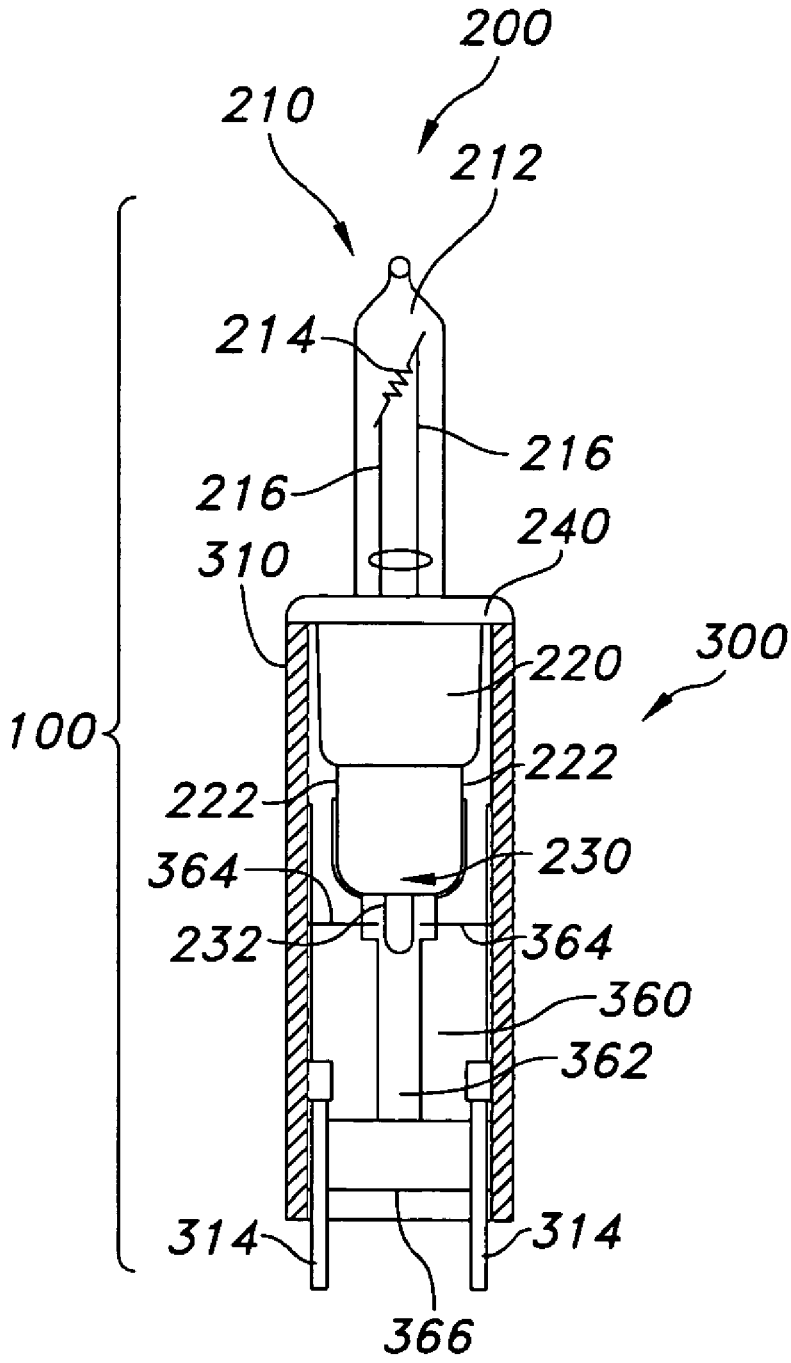

FIGS. 13-15 illustrate another preferred embodiment of the present invention. In FIGS. 13-15 the bypass activating system 230 strikes a bypass mechanism 360 as a light assembly 200 is inserted into the socket 310. In this embodiment, the bypass mechanism 360 is a moveable contact 362, which at least the top portion of which is conductive. The moveable contact 362 can be an electric conductor material having a spring-like property. The moveable contact 362 is adapted to be a bridging or shorting mechanism across a pair of contacting members 364. When the base 220 of the light assembly 200 is inserted into the socket 310, the bypass activating system 230 can push against the top of the moveable contact 362, wherein disabling the bridge or short across the contacting members 364.

The light assembly 200 is adapted to be inserted into the socket 310. The socket 310 defines an aperture sufficiently sized to receive the light assembly 200. At a predetermined depth of the socket 310, a pair of contacting members 364 are positioned. The contacting members 364 are made of conducting material, e.g., metal, copper, and the like. The contacting members 364 extend inwardly from opposite sides of the socket 310. The contacting members 364 are separated by a distance (Δd) enabling the bypass activating system 230 to fit therebetween.

As the light assembly 200 is inserted into the socket 310, the bypass activating system 230 can make contact with the bypass mechanism 360. The lead wires 222, extending from the base 220 of the light assembly 200, can contact the contacting members 364, wherein energy can flow through the light assembly 200.

Figure 16:
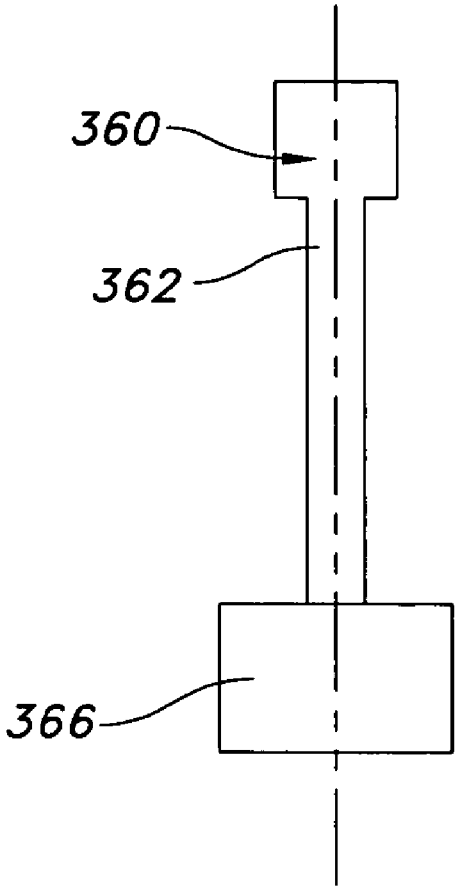
FIG. 16 is a close-up view of a moveable contact in accordance with an embodiment of the present invention.
Figure 17:
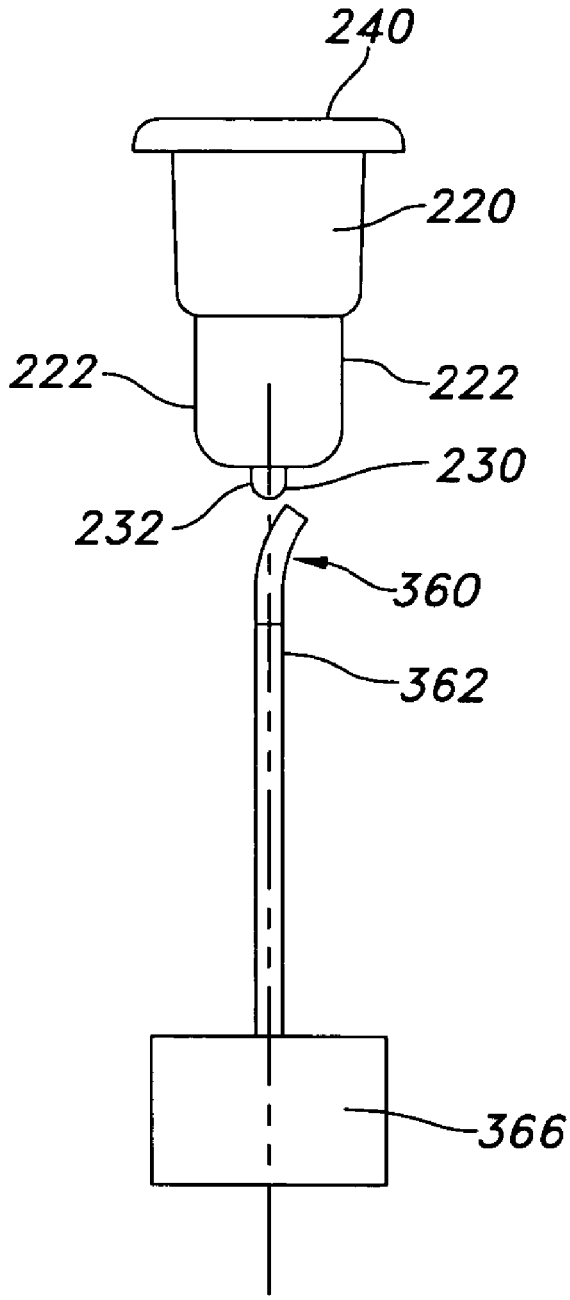
FIG. 17 is a side, close-up view of the moveable contact illustrating the movement of the movable contact.

The bypass mechanism 360 includes two positions—a first position and a second position. These positions are illustrated in FIGS. 16-17. The first position, depicted in FIG. 16, bypasses energy when the light assembly 200 is not seated in the socket 310. The second position of the bypass mechanism 360, depicted in FIG. 17 enables energy to flow through the light source 210, thereby enabling illumination of the light source 210.

The bypass mechanism 360, which can be the moveable contact 362, is in communication with a stopper 366. The stopper 366 can be made of plastic, polymers, and the like. The stopper 366 provides the stability to the bypass mechanism 360 necessary to enable the moveable contact 362 be able to flex.

In this embodiment, the bypass mechanism 360 can be designed to move lateral to the longitudinal shape of the socket 310. Accordingly, instead of moving in an up and down direction (as previously described), the bypass mechanism 360 moves side to side. The bypass mechanism 360 moves away from contacting members 364 and moves towards the inner wall of the socket 310. As illustrated in FIGS. 14-15, the bypass activating system 230 is depicted in front of the bypass mechanism 360, since the extending member 232 pushes the bypass mechanism 360 away from the contacting members 364. This is depicted from a side view in FIG. 17.

For instance, as illustrated in FIG. 13, which depicts the first position of the bypass mechanism 360, energy flows from the left terminal wire 314 to the left contacting member 364. The energy continues to flow through the conductive bypass mechanism 360, which acts like a shunt to connect the two contacting member 342. The energy then flows through the right contacting member 364 and out the right terminal wire 314. As the light assembly 200 is inserted into the socket, referring to FIGS. 14-15 wherein the bypass mechanism is placed in the second position, the bypass activating system 230 can push the bypass mechanism 360 away from the contacting members 364 to disable the shunt. Since at least a portion of the bypass activating system 230 is insulative, it prohibits energy to flow through the bypass mechanism 360 and, instead, allows illumination of the light source 210 of the light assembly 200.

Figure 18:
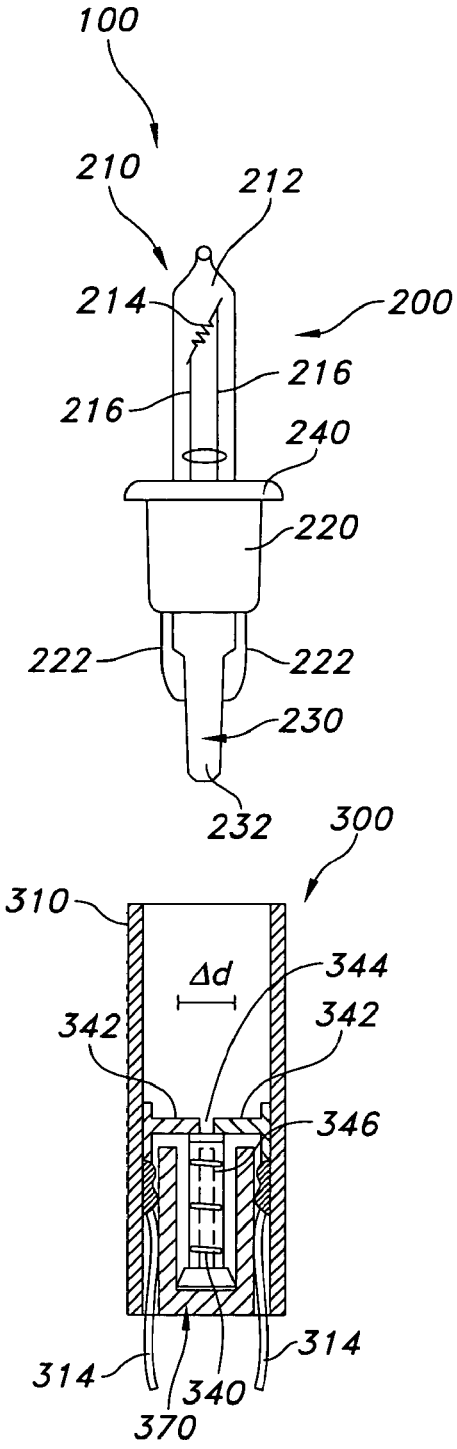
FIGS. 18-20 are cross sectional views of the lamp system for use in a light string system according to yet another preferred embodiment of the present invention.
Figure 19:
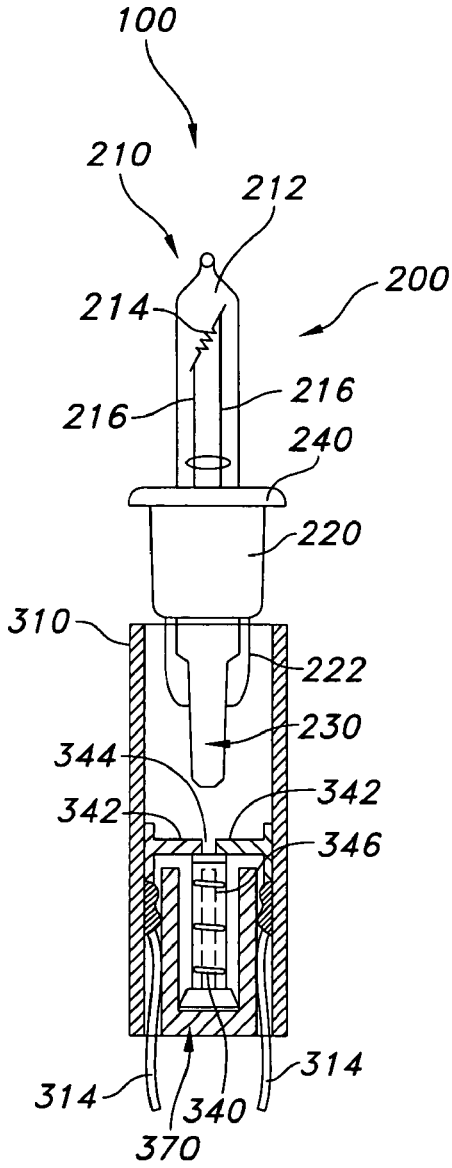
Figure 20:
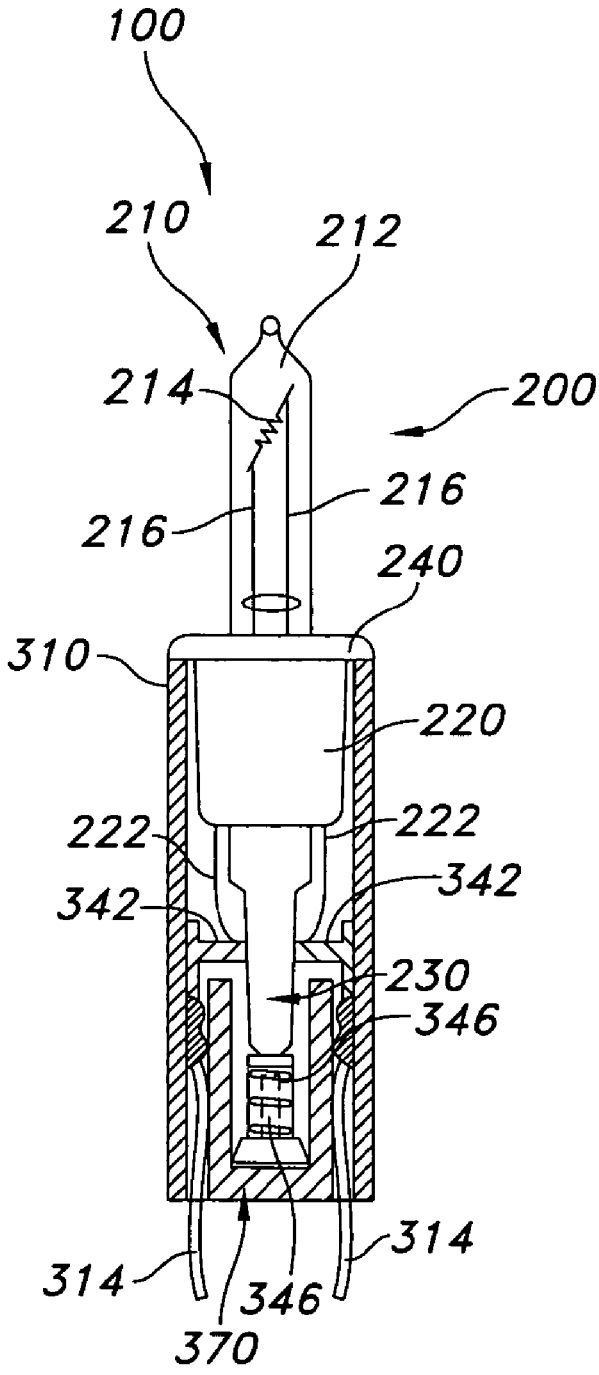

FIGS. 18-20 illustrate yet another embodiment of the present invention. FIGS. 18-20 depict a sealing assembly 370 for sealing the socket 310. For instance, the sealing assembly 370 can protect the socket 310 from its environment. The sealing assembly 370 can limit, if not eliminate, moisture, water, and the like from entering the socket 310. Alternatively, the sealing assembly 370 can further act as a base support for the bypass mechanism 340.

The sealing assembly 370 is preferably positioned between the two wires 314 and beneath the bypass mechanism 340, as to not interfere with the bypass activating system engaging the bypass mechanism 340.

The sealing assembly 370 has a cup-like shape. A bottom of the sealing assembly 370 is substantially flat. A top of the sealing assembly 370 is open, for receiving the bypass mechanism 340, and sides of the sealing assembly 370 extend from the bottom to the top. In a preferred embodiment, the sealing assembly 370 is made of plastic; the sealing assembly 370 can be made of plastic, polymers, and the like.

While the invention has been disclosed in its preferred forms, it will be apparent to those skilled in the art that many modifications, additions, and deletions can be made therein without departing from the spirit and scope of the invention and its equivalents, as set forth in the following claims.

What is claimed is:

1. A lamp system comprising:

a light assembly comprising a light source and a base, the base comprising a bypass activating system extending downwardly from the base, the bypass activating system comprising a single downwardly extending member;

a socket assembly dimensioned to receive via insertion the base of the light assembly, the socket assembly incorporating a bypass mechanism moveable between a first position and a second position, the bypass mechanism comprising a first moveable portion and comprising only conductive material, wherein the socket assembly comprises a fulcrum, wherein in the first position, current flow is bypassed from the light assembly, and across the socket assembly, wherein in the second position, current flow is directed through the light assembly, wherein upon insertion of the base of the light assembly into the socket assembly, the single downwardly extending member of the bypass activating system activates the first moveable portion of the bypass mechanism, disengaging it from a first internal side wall of the socket assembly, wherein the bypass mechanism is placed in the second position, and wherein upon removal of the base of the light assembly from the socket assembly, the first moveable portion of the bypass mechanism returns to engagement with the first internal side wall of the socket assembly, wherein the bypass mechanism is placed in the first position.

2. The lamp system of claim 1, wherein the first internal side wall is in electrical communication with a first socket terminal and the second internal side wall is in electrical communication with a second socket terminal.

3. The lamp system of claim 1, the bypass mechanism further comprising a second moveable portion.

4. The lamp system of claim 1, further comprising a locking assembly for securing the light assembly to the socket assembly.

5. The lamp system of claim 4, wherein the locking assembly is positioned on the exterior of the light assembly and the socket assembly.

6. The lamp system of claim 4, wherein the locking assembly comprises a light assembly element cooperating with a socket assembly element.

7. The lamp system of claim 1, wherein the bypass mechanism is carried by the fulcrum.

8. The lamp system of claim 7, wherein the socket assembly comprises a centrally-positioned fulcrum therein, and the bypass mechanism is carried by the centrally-positioned fulcrum.

9. The lamp system of claim 5, wherein the base of the light assembly compliments and facilitates the seating of the light assembly to the socket assembly.

10. A lamp system comprising:

a light assembly comprising a light source and a base, the base comprising a bypass activating system extending from the base, the bypass activating system comprising a first extending member;

a socket assembly dimensioned to receive via insertion the base of the light assembly, the socket assembly incorporating a bypass mechanism moveable between a first position and a second position, the bypass mechanism comprising a first moveable portion and a second moveable portion, wherein the socket assembly comprises a fulcrum, wherein in the first position, current flow is bypassed from the light assembly, and across the socket assembly, wherein in the second position, current flow is directed through the light assembly, wherein upon insertion of the base of the light assembly into the socket assembly, the first extending member of the bypass activating system activates one of the first moveable portion or the second moveable portion of the bypass mechanism, disengaging either the first moveable portion or the second moveable portion from either a first internal side wall or a second internal side wall of the socket assembly, respectively, wherein the bypass mechanism is placed in the second position, and wherein upon removal of the base of the light assembly from the socket assembly, either the first moveable portion or the second moveable portion of the bypass mechanism returns to engagement with either the first internal side wall or the second internal side wall of the socket assembly, respectively, wherein the bypass mechanism is placed in the first position.

11. The lamp system of claim 10, further comprising a locking assembly for securing the light assembly to the socket assembly.

12. The lamp system of claim 11, wherein the locking assembly is positioned on the exterior of the light assembly and the socket assembly.

13. The lamp system of claim 11, wherein the locking assembly comprises a light assembly element cooperating with a socket assembly element.

14. The lamp system of claim 10, wherein the bypass mechanism is carried by the fulcrum.

15. The lamp system of claim 10, wherein the socket assembly comprises a centrally-positioned fulcrum therein, and the bypass mechanism is carried by the centrally-positioned fulcrum.

16. The lamp system of claim 10, wherein the base of the light assembly compliments and facilitates the seating of the light assembly to the socket assembly.

17. A lamp system comprising:

a light assembly comprising a light source and a base, the base comprising a bypass activating system extending downwardly from the base, the bypass activating system comprising a single downwardly extending member;

a socket assembly dimensioned to receive via insertion the base of the light assembly, the socket assembly incorporating a bypass mechanism moveable between a first position and a second position, the bypass mechanism comprising a first moveable portion and comprising only conductive material, wherein in the first position, current flow is bypassed from the light assembly, and across the socket assembly, wherein in the second position, current flow is directed through the light assembly, wherein when the base of the light assembly is seated in the socket assembly, the single downwardly extending member of the bypass activating system is in contact with the first moveable portion of the bypass mechanism, and wherein the bypass mechanism is in the second position, thus current flows from a first socket terminal through a first internal side wall of the socket assembly through the first movable portion through a second moveable portion through a second internal side wall of the socket assembly and through a second socket terminal, and wherein when the base of the light assembly is absent from the socket assembly, the first moveable portion of the bypass mechanism engages the first internal side wall of the socket assembly, wherein the bypass mechanism is in the first position.

18. A lamp system comprising:

a light assembly comprising a light source and a base, the base comprising a bypass activating system extending downwardly from the base, the bypass activating system comprising a single downwardly extending member;

a socket assembly dimensioned to receive via insertion the base of the light assembly, the socket assembly incorporating a bypass mechanism moveable between a first position and a second position, the bypass mechanism comprising a first moveable portion and comprising only conductive material, a locking assembly for securing the light assembly to the socket assembly, wherein in the first position, current flow is bypassed from the light assembly, and across the socket assembly, wherein in the second position, current flow is directed through the light assembly, wherein upon insertion of the base of the light assembly into the socket assembly, the single downwardly extending member of the bypass activating system activates the first moveable portion of the bypass mechanism, disengaging it from a first internal side wall of the socket assembly, wherein the bypass mechanism is placed in the second position, and wherein upon removal of the base of the light assembly from the socket assembly, the first moveable portion of the bypass mechanism returns to engagement with the first internal side wall of the socket assembly, wherein the bypass mechanism is placed in the first position.

19. A lamp system comprising:

a light assembly comprising a light source and a base, the base comprising a bypass activating system extending from the base, the bypass activating system comprising a first extending member;

a socket assembly dimensioned to receive via insertion the base of the light assembly, the socket assembly incorporating a bypass mechanism moveable between a first position and a second position, the bypass mechanism comprising a first moveable portion and a second moveable portion, a locking assembly for securing the light assembly to the socket assembly, wherein in the first position, current flow is bypassed from the light assembly, and across the socket assembly, wherein in the second position, current flow is directed through the light assembly, wherein upon insertion of the base of the light assembly into the socket assembly, the first extending member of the bypass activating system activates one of the first moveable portion or the second moveable portion of the bypass mechanism, disengaging either the first moveable portion or the second moveable portion from either a first internal side wall or a second internal side wall of the socket assembly, respectively, wherein the bypass mechanism is placed in the second position, and wherein upon removal of the base of the light assembly from the socket assembly, either the first moveable portion or the second moveable portion of the bypass mechanism returns to engagement with either the first internal side wall or the second internal side wall of the socket assembly, respectively, wherein the bypass mechanism is placed in the first position.

* * * * *